US005346216A

United States Patent [19]

Aizawa

[11] Patent Number: 5,346,216

[45] Date of Patent: Sep. 13, 1994

[54] GOLF CLUB HEAD

[75] Inventor: Yuichi Aizawa, Tokyo, Japan

[73] Assignee: Daiwa Golf Co., Ltd., Higashikurume, Japan

[21] Appl. No.: 20,974

[22] Filed: Feb. 22, 1993

[30] Foreign Application Priority Data

Feb. 27, 1992 [JP] Japan ..... 4-009228[U]

[51] Int. Cl.[5] ..... A63B 53/04

[52] U.S. Cl. ..... 273/167 H; 273/DIG. 23; 273/173; 273/78

[58] Field of Search ..... 273/167 R, 77 A, 193 R, 273/194 R, 194 A, DIG. 7, DIG. 23, 80 C, 162 R, 186.2, 187.4, 77 R, DIG. 3, DIG. 10, 79

[56] References Cited

U.S. PATENT DOCUMENTS

| | | | |
|---|---|---|---|
| 1,665,523 | 4/1928 | Boyce | 273/173 X |
| 1,673,973 | 6/1928 | Drevitson | 273/167 F |
| 3,817,522 | 6/1974 | Simmons | 273/78 X |
| 3,975,023 | 8/1976 | Inamori | 273/173 |
| 4,149,726 | 4/1979 | Tredway | 273/78 X |
| 4,214,754 | 7/1980 | Zebelean | 273/167 F X |
| 4,367,878 | 1/1983 | Schmidt | 273/175 |
| 4,618,149 | 10/1986 | Maxel | 273/79 |
| 4,732,389 | 3/1988 | Kobayashi | 273/169 |
| 4,809,978 | 3/1989 | Yamaguchi | 273/173 X |
| 5,106,094 | 4/1992 | Desbiolles | 273/169 X |

FOREIGN PATENT DOCUMENTS

| | | | |
|---|---|---|---|
| 211781 | 12/1957 | Australia | 273/173 |
| 5321070 | 2/1978 | Japan . | |
| 1-259876 | 10/1989 | Japan . | |
| 2-29973 | 8/1990 | Japan . | |
| 404288173 | 10/1992 | Japan | 273/167 J |
| 1056979 | 2/1967 | United Kingdom | 273/170 |

*Primary Examiner*—Theatrice Brown
*Assistant Examiner*—Sebastiano Passaniti
*Attorney, Agent, or Firm*—Longacre & White

[57] ABSTRACT

A golf club head which is more durable, capable of driving a golf ball further and providing a desirable, "soft" feeling when hitting the golf ball. These objectives are achieved by configuring the head to efficiently transmit and store potential energy due to impact with the golf ball. The head comprises a hollow shell defining a cup portion and an opening or concave portion which receives a face plate. The face plate forms a contact surface for striking a golf ball. The structural arrangement causes the hollow shell to elastically deform upon contact with a golf ball to enhance driving performance.

27 Claims, 6 Drawing Sheets

GOLF CLUB HEAD

BACKGROUND OF THE INVENTION

Field of the Invention

The present invention relates to an improvement for metal golf club heads.

b) Description of the Prior Art

Recently, golf clubs which were originally called "wood clubs" have been developed in which the golf club head comprises a synthetic resin foam core material surrounded by an outer shell. For example, it is known to use a carbon fiber reinforced resin layer which is compression molded onto the surface of the core material. It is also known to form an outer shell from materials such as stainless steel, titanium and fiber reinforced metallic composites. The advantages of artificial "wood" club heads over natural "wood" club heads, traditionally milled from persimmon or cherry wood, are uniformity of construction and consistency of performance.

Generally, golf club heads with a metal outer shell provide an unpleasant, "hard" feeling when hitting a golf ball. FIG. 5 shows the golf club head disclosed in Japanese Examined Utility Model Publication No. Hei. 2-29973 which recognizes this problem. This reference suggests making the ball hitting surface 3 more elastic with respect to the metal outer shell 1 using reduced cross-section portions 7 around the face plate 5. The disadvantage being the stresses due to impact with the ball are concentrated in the reduced cross-section portions 7, potentially resulting in damage or failure over a long period of use.

Japanese Unexamined Patent Publication No. Hei. 1-259876 suggests further increasing the elasticity of metal golf club heads by the attachment of face member 15 to the outer shell 9. Specifically, the face member 15, made of fiber reinforced plastic in the reference, is attached to face portion 11 of exterior recess 13 formed in the outer shell 9. However, adequate elasticity is achieved only in the proximity of where the recess 13 connects with the V-shaped portion of the outer shell 9, i.e. near the upper portion of the shell 9 as shown in FIG. 6. The remaining portions of the face member provide substantially less elasticity.

SUMMARY OF THE INVENTION

To overcome the aforementioned disadvantages of the prior art, it is an object of the present invention to provide a more durable golf club head capable of driving the golf ball further and providing a desirable, "soft" feeling when hitting the golf ball.

The above-noted, as well as other objects which are discussed below with respect to the present invention, are provided by a golf club head comprising: a hollow shell including an opening portion and a cup portion sharing a first common perimeter, with the opening portion extending into the cup portion, a bottom sharing a second common perimeter with the opening portion, and a face plate received in and substantially filling the opening portion. The opening portion is tapered such that the first common perimeter is larger than the second common perimeter, and the face plate is generally secured to the bottom. The opening portion defines a plane oriented at an acute angle relative to an imaginary straight line on which a "sweet" spot and a gravity center of the golf club head are located.

Another golf club head provided by the present invention comprises: a hollow shell including a concave portion and a cup portion sharing a con, non perimeter, with the concave portion extending into the cup portion, and a face plate received in and substantially filling the concave portion. The concave portion may also be semi-cylindrical with a generally horizontal centerline or parabolic.

Yet another golf club head provided by the present invention comprises: a hollow shell including a cup portion with an opening having a first perimeter, a bottom located inside the cup portion and sharing a common perimeter therewith which is relatively larger than the first perimeter, and a face plate received in and substantially filling a recess bounded between the first perimeter and the bottom. The bottom may be either planar or a curved surface.

In each of the golf club heads provided by the present invention, the thickness of the cup portion may be reduced further from the opening thereto.

DETAILED DESCRIPTION OF THE PREFERRED EMBODIMENTS

Preferred embodiments of the present invention will now be described in detail with reference to the attached FIGS. 1 to 4, 7 and 8.

Figure 1:
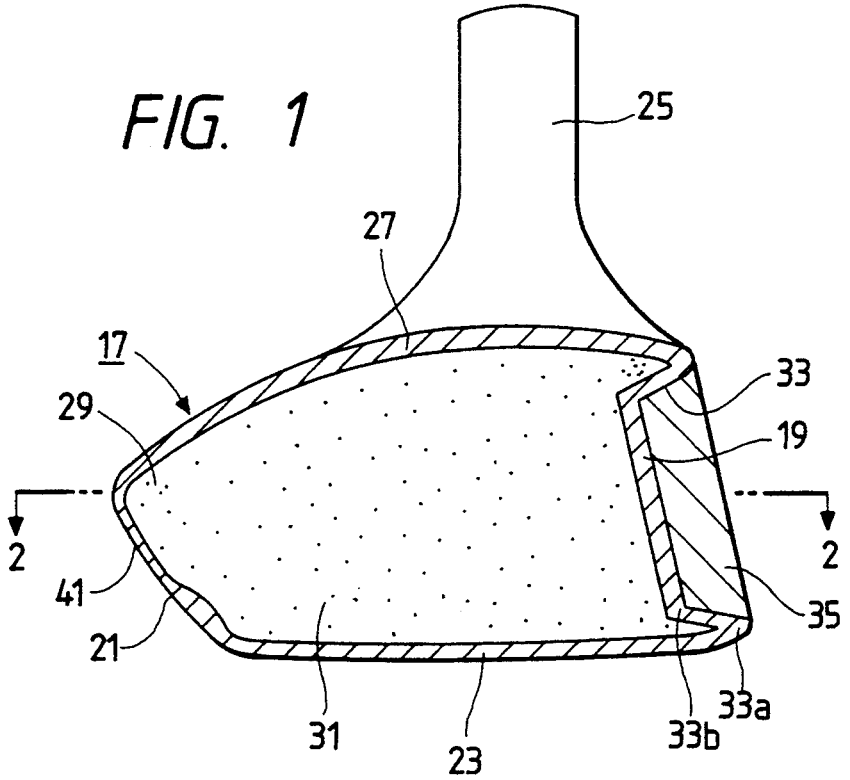
FIG. 1 is a longitudinal section view showing a golf club head according to a first embodiment of the present invention.
Figure 2:
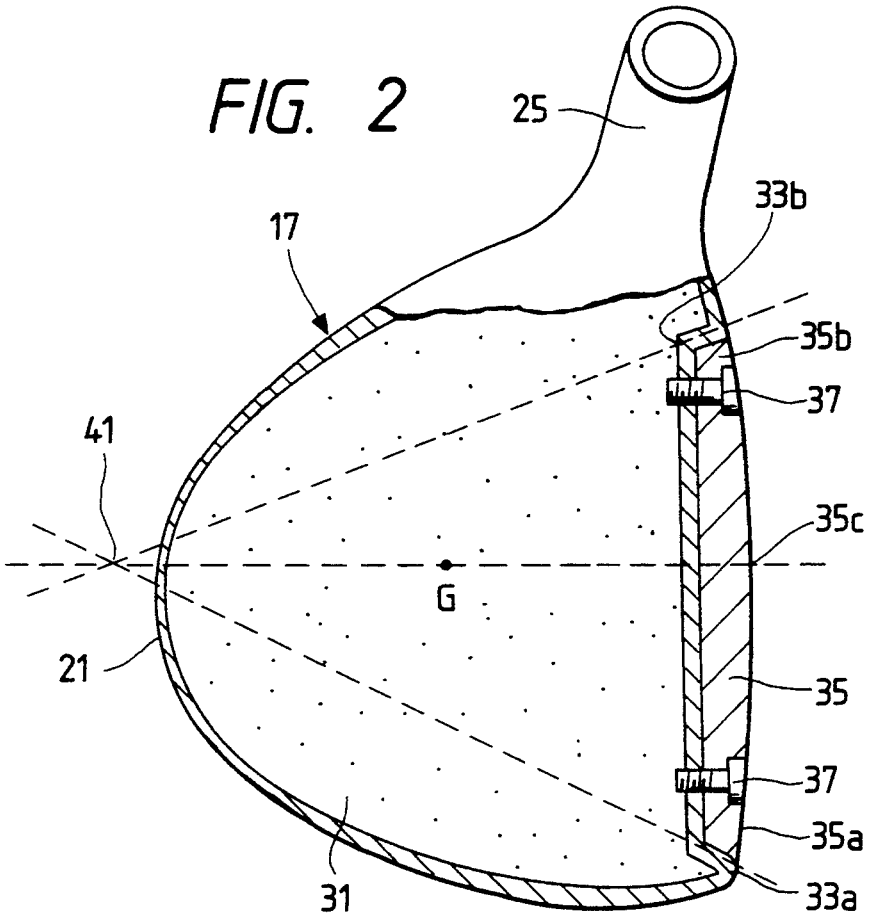
FIG. 2 is a partial transverse section taken along line 2—2 in FIG. 1.
Figure 2A:
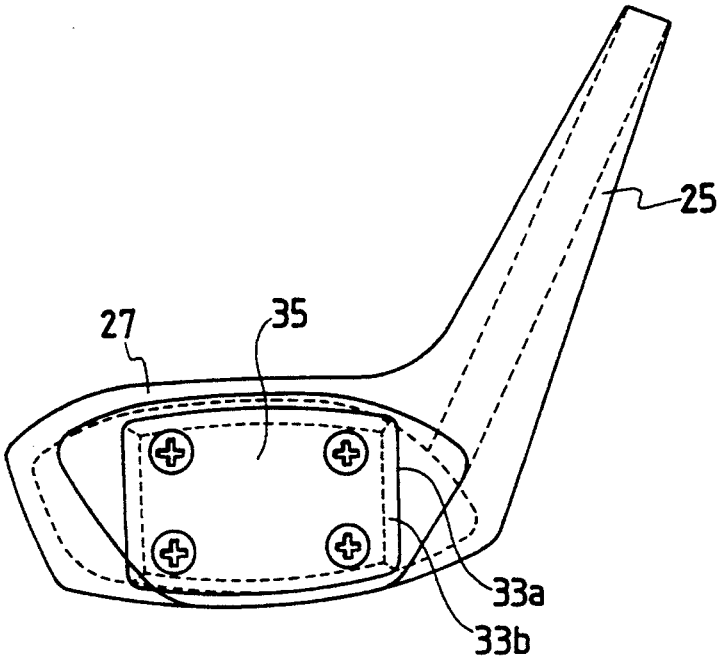
FIG. 2*a* is a front view of the golf club head of the first embodiment of the present invention in the direction of the face plate.
Figure 4E:
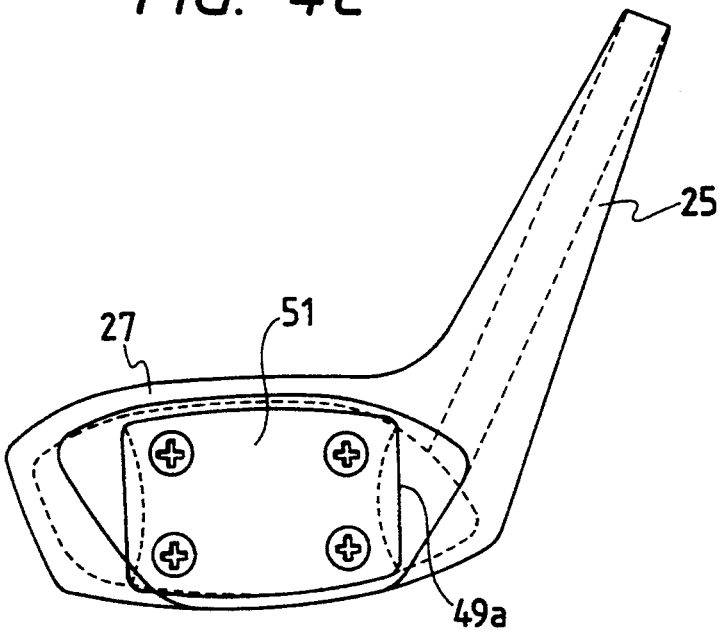
FIG. 4*e* is a front view of the golf club head of the second embodiment of the present invention in the direction of the face plate.
Figure 3:
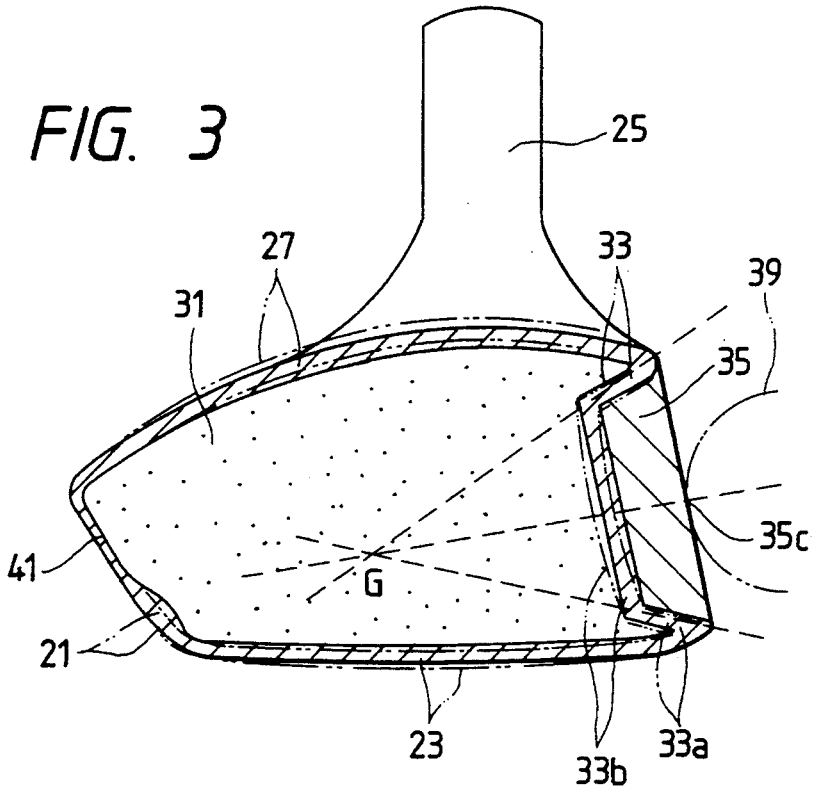
FIG. 3 is a longitudinal section view of the first embodiment illustrating the effect of the golf club head hitting the golf ball.

FIGS. 1 to 3 show a metal golf club head according to the first embodiment of the present invention. The head includes a hollow shell 17 made from a material such as stainless steel, titanium, aluminum alloy, iron or fiber reinforced metallic composites. The shell 17 is formed by a cup portion 21 (including sole portion 23, hosel portion 25 and top portion 27), an opening portion 33, and a bottom 19. The inner chamber 29 of the shell 17 is filled with a filling member 31 such as synthetic resin foam. The opening portion 33 receives a face plate 35 made of metal, synthetic resin, ceramics, fiber reinforced resin, etc. which is secured to the bottom 19 with adhesive and/or screw(s) 37 as shown in FIG. 3. The end(s) of screw(s) 37 are flush with a ball hitting surface on the face plate 35.

The components of the shell 17 (cup portion 21, opening portion 33 and bottom 19) are either integrally formed or subsequently joined such that the cup portion 21 and the opening portion 33 share a first con, non perimeter 33*a*. Similarly, the bottom 19 and the opening portion 33 share a second common perimeter 33*b*.

The opening portion 33 extends from the first common perimeter 33*a* into the interior of the cup portion 21, thereby creating a V-shape with the first con, non perimeter 33*a* at the apex. Further, the first common perimeter 33*a* is also relatively larger than the second common perimeter 33*b*.

As illustrated with two-dotted chain line in FIG. 3, when the face plate 35 hits a golf ball 39, the bottom 19 is elastically deformed into the cup portion 21 due to the impact with the golf ball 39, thereby storing potential energy. Potential energy is also stored during the associated elastic deformation of the opening portion 33 and the cup portion 21.

As shown in FIG. 2, the thickness of the face plate 35 is increased near a "sweet" spot 35*c* relative to its toe side 35*a* and heel side 35*b*, thereby defining a curved ball hitting surface. The curved ball hitting surface enhances a gear effect between the ball 39 and ball hitting surface when the golf ball is hit. That is to say, when golf ball 39 is not hit with the sweet spot 35*c*, the curved ball hitting surface functions to drive the ball near the intended orbit. The face plate 35 may also be made of woven fabric reinforced synthetic resin which provides excellent elastic energy transmission characteristics between the hollow shell 17 and the ball 39 as compared with the other materials mentioned previously.

The bottom 19, the opening portion 33, the sole portion 23 and the top portion 27 of the hollow shell 17 have substantially the same wall thickness. However, wall thickness may be reduced nearer to a back portion 41 of the cup portion 21 so as to more readily store potential energy from the diminished deformation forces received at the back portion 41. Consequently, potential energy is stored in the entire shell 17.

When a golf ball 39 is hit with the golf club according to the present invention as described above, the bottom 19 is elastically deformed into the cup portion 21 and the opening portion 33 is also elastically deformed as shown by two-dotted line in FIG. 3 so that the impact transmitted through the face plate 35 is stored as potential energy the hollow shell 17. Further, the sole portion 23 and the top portion 27 are also elastically deformed, as is the reduced thickness back portion 41 of the cup portion 21, so that the impact of the golf club head hitting the golf ball 39 is stored as potential energy throughout the entire shell 17. Subsequently, all of the potential energy is transmitted back to the golf ball 39 so as to drive the golf ball 39 further.

Moreover, since the bottom 19 and opening portion 33 are simultaneously deformed, and the sole portion 23 and top portion 27 are also elastically deformed, as is the reduced thickness back portion 41 of the cup portion 21, the deformation absorbs the impact so as to provide a "soft" feeling when hitting the golf ball 39, as well as minimize stress concentration which could otherwise damage or brake the bottom 19.

Figure 5:
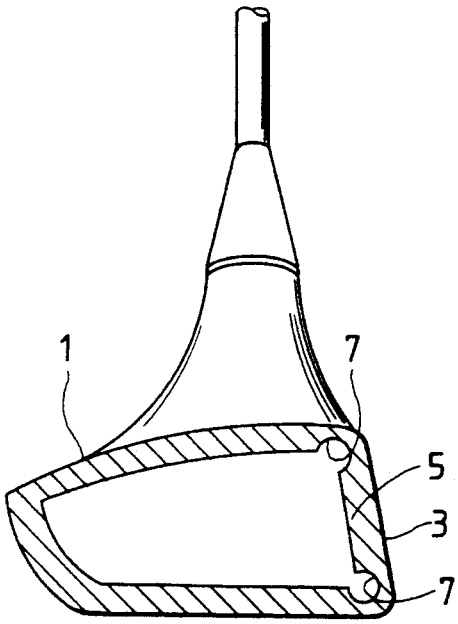
FIG. 5 PRIOR ART
FIG. 5 is a longitudinal section view showing a first known golf club head.
Figure 6:
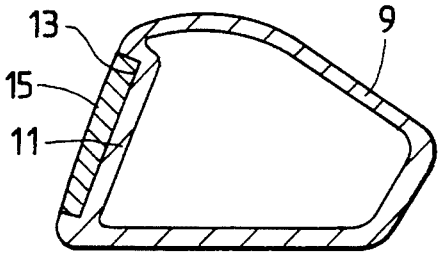
FIG. 6 PRIOR ART
FIG. 6 is a longitudinal section view showing a second known golf club head.

Therefore, the golf club head according to the present invention is more durable with respect to the impact caused when hitting a golf ball, enhances driving performance in comparison with the prior art shown in FIGS. 5 and 6, and provides a "soft" feeling when hitting a golf ball due the deformation and potential energy stored throughout the entire shell 17.

Figure 4A:
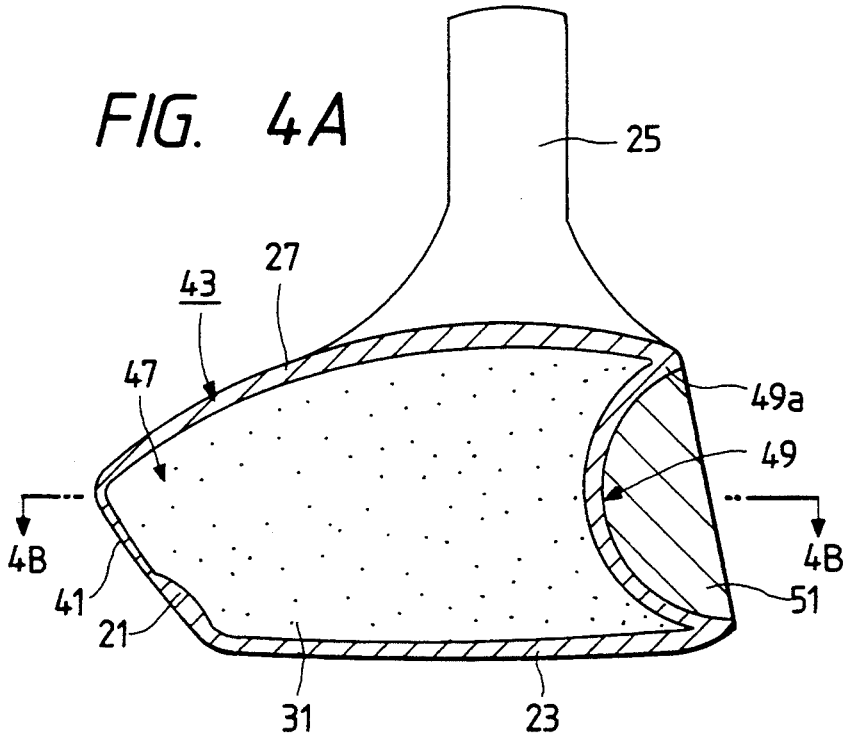
FIG. 4A is a longitudinal section view showing a golf club head having a semi-cylindrical concave portion according to a second embodiment of the present invention.
Figure 4B:
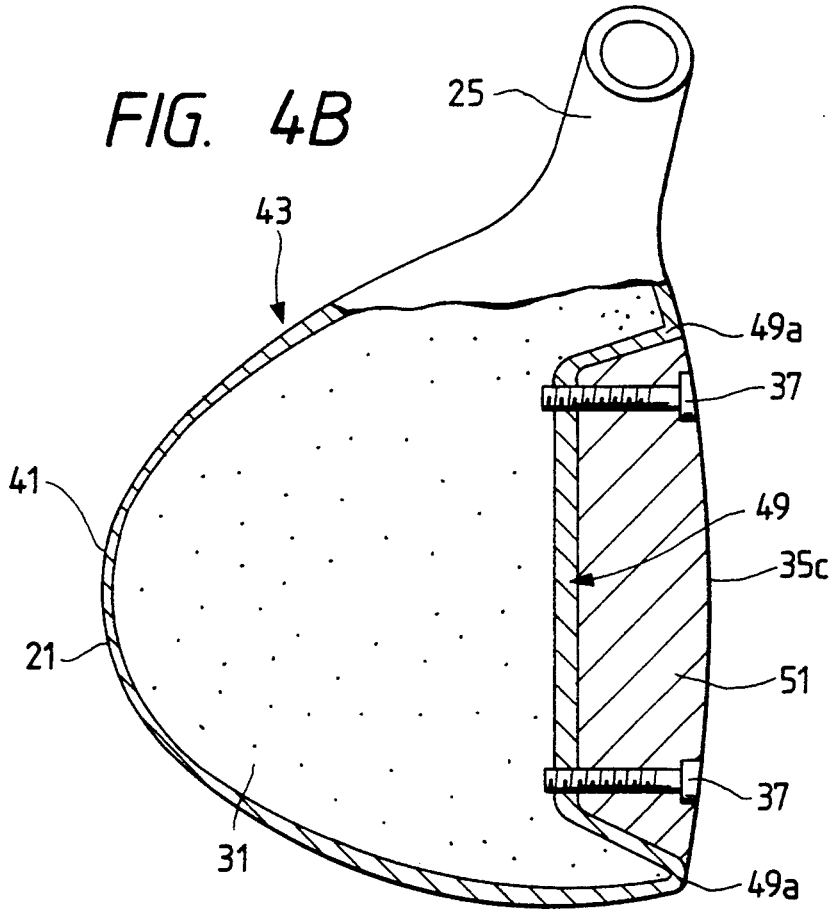
FIG. 4B is a partial transverse section taken along line 4B—4B in FIG. 4A.
Figure 4C:
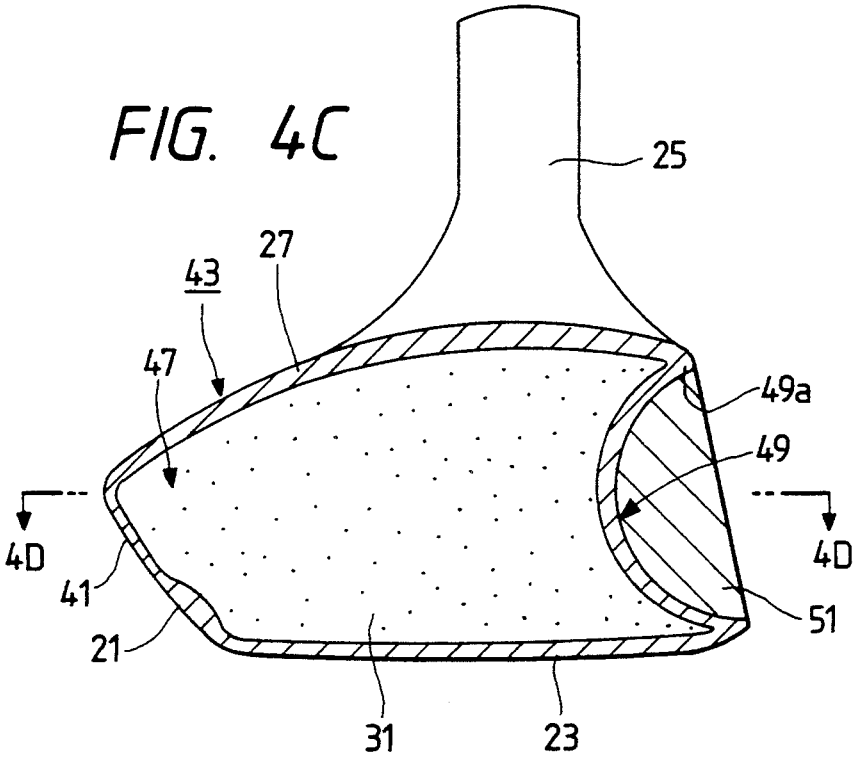
FIG. 4C is a longitudinal section view showing a golf club head having a parabolic concave portion according to the second embodiment of the present invention.
Figure 4D:
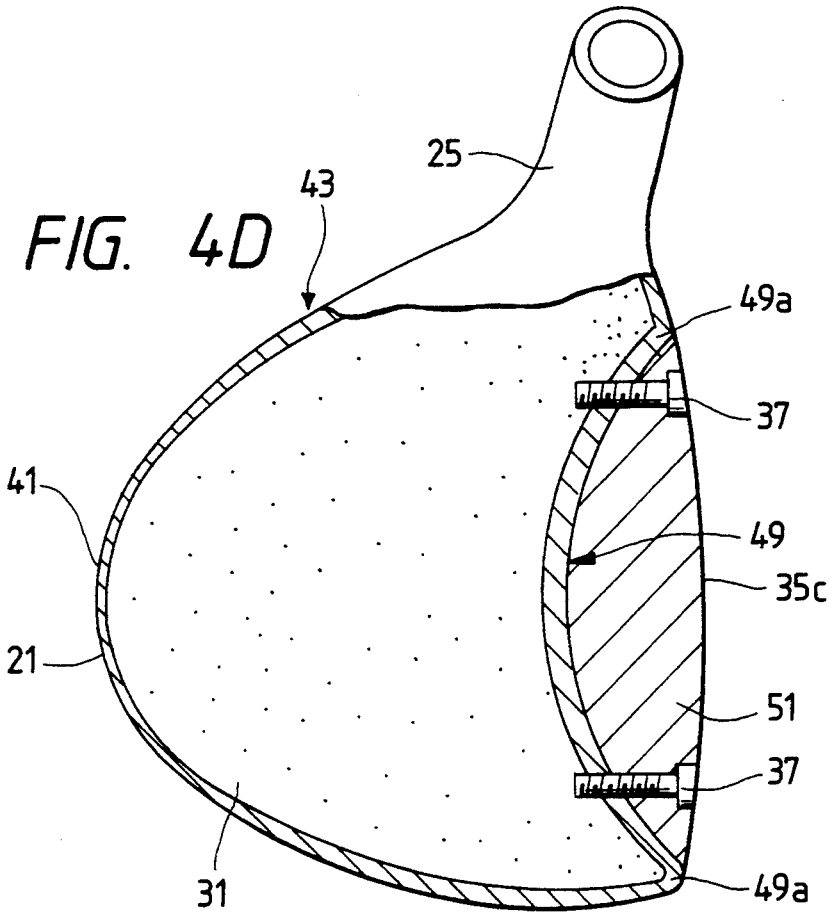
FIG. 4D is a partial transverse section taken along line 4D—4D in FIG. 4C.

FIGS. 4A to 4C show a golf club head according to the second embodiment of the present invention including a concave portion 49, which may be semi-cylindrical (FIGS. 4A and 4B) or parabolic (FIGS. 4C and 4D), in place of the opening portion 33 and the bottom 19 of the first embodiment. Unless otherwise noted, reference numerals common to both the first and the second embodiments denote equivalent parts.

In FIGS. 4A to 4C, reference numeral 43 designates a hollow shell (in place of the hollow shell 17 in the first embodiment) formed by the cup portion 21, the sole portion 23, the hosel portion 25, the top portion 27 and the concave portion 49, all of which are made of the same material. An inner chamber 47 of the hollow shell 43 is filled with a filling member 31. The cup portion 21 may also have reduced wall thickness in the proximity of back portion 41, as discussed previously.

The components of the shell 43 (cup portion 21 and concave portion 49) are either integrally formed or subsequently joined such that the cup portion 21 and the concave portion 49 share a first perimeter 49*a*.

A face plate 51 having a curved golf ball hitting surface similar to the face plate 35 in the first embodiment, is mounted and secured to the concave portion 49 with adhesive and/or screw(s), as described above.

when a golf ball 39 is hit with the golf club head according to the second embodiment, the concave portion 49 is elastically deformed into the interior of the cup portion 21. The impact with the golf ball 39 is transmitted through the face plate 51 to the hollow shell 43, storing potential energy. The sole portion 23 and rod portion 27 of the outer shell 43 are also deformed, as is the reduced thickness back portion 41, so that potential energy is stored throughout the outer shell 43. Subsequently, the potential energy is transmitted back to the golf ball 39 to drive the golf ball 39 further.

Further, since the distance between the correct ball hitting point and the concave portion 49 is uniform by virtue of the semi-circular cross-sectional shape, the stored potential energy can be efficiently transmitted back to the golf ball 39.

Moreover, since the concave portion 49, the sole portion 23 and top portion 27 are elastically deformed, as is the reduced thickness back portion 41 of the cup portion 21, the deformation absorbs the impact to provide a "soft" feeling when hitting the golf ball 39, as well as minimize stress concentration which could otherwise damage or brake the concave portion 49.

Therefore, the golf club head according to the second embodiment of present invention is also more durable with respect to the impact caused when hitting a golf ball, also enhances driving performance in comparison with the prior art shown in FIGS. 5 and 6, and also provides a "soft" feeling when hitting a golf ball due the deformation and potential energy stored throughout the entire shell 43.

Figure 7:
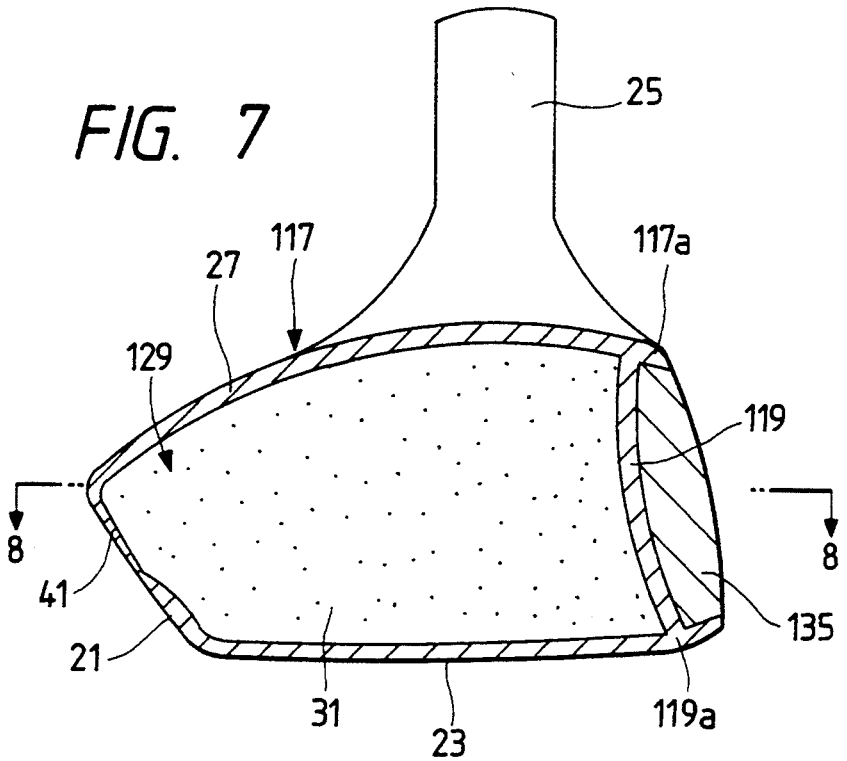
FIG. 7 is a longitudinal section view showing a golf club head according to a third embodiment of the present invention.
Figure 8:
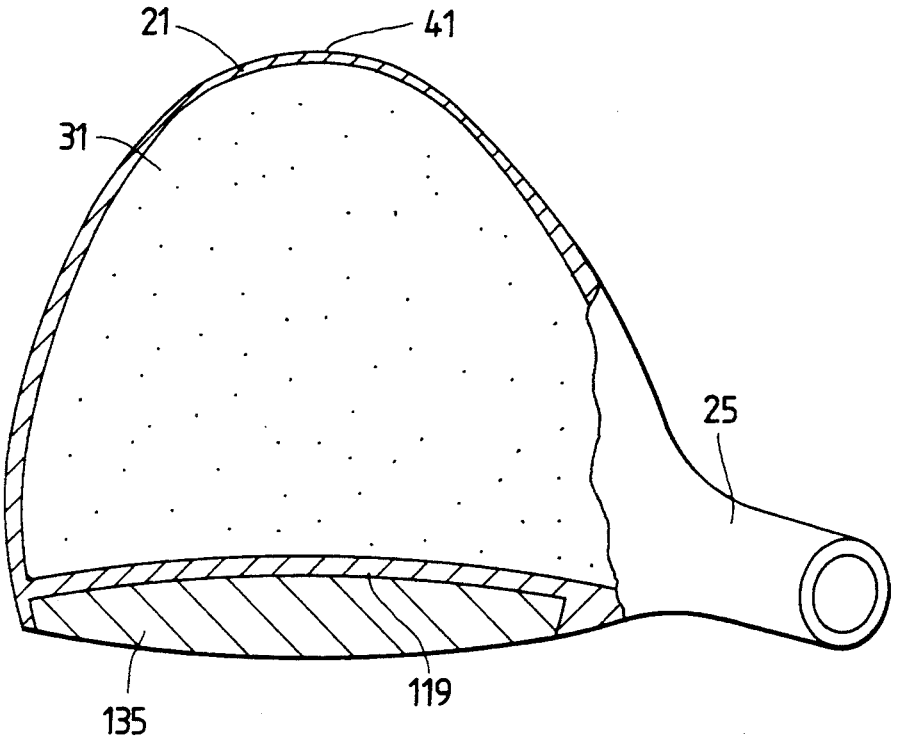
FIG. 8 is a partial transverse section taken along line 8—8 in FIG. 7.

FIGS. 7 and 8 show a golf club head according to the third embodiment of the present invention. A hollow shell 117 is formed by the cup portion 21, including the sole portion 23, the hosel portion 25 and the top portion 27, as similarly described with respect to the first and second embodiments, and a bottom 119 located inside the cup portion 21. The bottom 119 and the cup portion 21 share a common perimeter 119*a* which is larger than perimeter 117*a* of the opening of the cup portion. A face plate 135 is forcibly inserted into the recess bounded between the opening perimeter 117*a* and the bottom 119, or the face plate 135 may be molded in situ with a curved ball hitting surface.

In the third embodiment, the bottom 119 may be either planar or have a curved surface to minimize stress concentration when hitting the golf ball 39. The curved bottom 119 and the reduced wall thickness at the back portion 41 enable the entire hollow shell 117 to be elastically deformed and efficiently store and transmit potential energy due to the impact with the golf ball 39. An inner chamber 129 of the hollow shell 117 is similarly filled with the filling member 31.

Further, since the opening perimeter 117*a* is smaller than the common perimeter 119*a*, the face plate 135 is securely fixed to the hollow shell 117 without adhesives or screws, regardless of the vibration of the golf club head.

The hollow shell 17, 43, 117 may also remain hollow without filling the inner chamber with the filling member 31, and still provide the desired effect.

What is claimed is:

1. A golf club head, comprising:

a hollow shell including an opening portion and a cup portion sharing a first common perimeter, said opening portion extending into said cup portion and comprising at least one surface;

a bottom sharing a second common perimeter with said opening portion, said first common perimeter being dimensionally larger than said second common perimeter; and a face plate received in and substantially filling a recess defined by the opening portion, said face plate defining a striking surface for striking a golf ball;

wherein said first common perimeter circumscribes said striking surface, and said opening portion, said cup portion and said bottom enclose an inner chamber.

2. The golf club head according to claim 1, wherein the opening portion defines a plane oriented at an acute angle relative to an imaginary straight line on which a sweet spot and a center of gravity of the golf club head are located.

3. The golf club head according to claim 1, wherein said bottom is planar.

4. The golf club head according to claim 1, wherein said inner chamber encapsulates a filling member.

5. The golf club head according to claim 1, wherein said face plate is secured to said bottom.

6. The golf club head according to claim 5, wherein said face plate is secured to said bottom with a screw countersunk flush with a ball hitting surface on said face plate.

7. The golf club head according to claim 6, wherein said ball hitting surface is a convex surface.

8. The golf club head according to claim 1, wherein wall thickness is reduced at a back portion of said cup portion with respect to a front portion of said cup portion, said back portion being distal and said front portion being proximate with respect to said opening portion.

9. The golf club head according to claim 1, wherein said hollow shell is made of metal, and said face plate is made of synthetic resin.

10. The golf club head according to claim 1, wherein all surfaces defined by said opening portion converge in a direction from said first common perimeter to said second common perimeter toward a center of gravity of the golf club head.

11. The golf club head according to claim 1, wherein said first common perimeter defines a closed curve bounding a curved area, said striking surface lying substantially in said curved area.

12. The golf club head according to claim 1, wherein said first common perimeter defines a closed curve bounding a curved area, said striking surface lying substantially in said curved area.

13. The golf club head according to claim 1, wherein said face plate is exposed only at said striking surface.

14. The golf club head according to claim 1, wherein said face plate is exposed only at said striking surface.

15. A gold club head, comprising:

a hollow shell including a concave portion and a cup portion sharing a common perimeter at a distal end of said concave and cup portions to form an enclosed inner chamber, said concave portion extending into said cup portion; and a face plate received in and substantially filling a recess defined by said concave portion, said face plate defining a striking surface for striking a golf ball, wherein said distal end is positioned adjacent said striking surface.

16. The golf club head according to claim 15, wherein said concave portion is substantially semicylindrical in cross-section.

17. The golf club head according to claim 15, wherein said concave portion is substantially parabolic in cross-section.

18. The golf club head according to claim 15, wherein said face plate includes a ball hitting surface opposite said concave portion.

19. The golf club head according to claim 18, wherein said ball hitting surface is a convex surface.

20. The golf club head according to claim 10, wherein wall thickness is reduced at a back portion of said cup portion with respect to a front portion of said cup portion, said back portion being distal and said front portion being proximate with respect to said common perimeter.

21. The golf club head according to claim 15, wherein said hollow shell is made of metal, and said face plate is made of synthetic resin.

22. A golf club head, comprising:

a hollow shell including a cup portion having an opening perimeter, a bottom located inside said cup portion thereby defining a recess in said club head, said bottom and said cup portion sharing a common perimeter, said common perimeter being dimensionally larger than said opening perimeter; and a face plate received in and substantially filling said recess bounded between said opening perimeter and said bottom, said face plate defining a striking surface for a golf ball;

wherein said opening perimeter circumscribes said striking surface.

23. The golf club head according to claim 22, wherein said bottom is planar.

24. The golf club head according to claim 22, wherein said face plate in said recess is secured to said bottom.

25. The golf club head according to claim 22, wherein wall thickness is reduced at a back portion said cup portion with respect to a front portion of said cup portion, said back portion being distal and said front portion being proximate with respect to said opening perimeter.

26. The golf club head according to claim 22, wherein said hollow shell is made of metal, and said face plate is made of synthetic resin.

27. The golf club head according to claim 22, wherein said concave portion and said cup portion are joined only at said common perimeter.

* * * * *